US006736664B2

(12) United States Patent
Ueda et al.

(10) Patent No.: US 6,736,664 B2
(45) Date of Patent: May 18, 2004

(54) PIERCING TERMINAL AND MACHINE AND METHOD FOR CRIMPING PIERCING TERMINAL

(75) Inventors: Hirohisa Ueda, Shizuoka (JP); Hiroki Kondo, Shizuoka (JP); Toshisada Murayama, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/187,844

(22) Filed: Jul. 3, 2002

(65) Prior Publication Data

US 2003/0008548 A1 Jan. 9, 2003

(30) Foreign Application Priority Data

Jul. 6, 2001 (JP) ..... 2001-206372
Jul. 6, 2001 (JP) ..... 2001-206373
Jul. 6, 2001 (JP) ..... 2001-206374

(51) Int. Cl.[7] ..... H01R 4/24
(52) U.S. Cl. ..... 439/423
(58) Field of Search ..... 439/422, 423, 439/424, 425, 426

(56) References Cited

U.S. PATENT DOCUMENTS 4,082,402 A * 4/1978 Kinkaid et al. ..... 439/422
4,560,224 A * 12/1985 Weisenburger ..... 439/422
4,832,620 A * 5/1989 Yamamoto ..... 439/422
5,078,617 A * 1/1992 Gutierrez et al. ..... 439/422
6,267,618 B1 * 7/2001 Hio ..... 439/422
6,309,241 B2 * 10/2001 Nagai ..... 439/422
6,394,836 B2 * 5/2002 Nagai ..... 439/422
6,439,921 B1 * 8/2002 Hio ..... 439/422

FOREIGN PATENT DOCUMENTS

GB 2 210 514 * 6/1989
JP 50-100585 8/1975
JP 3-257769 * 11/1991

* cited by examiner

*Primary Examiner*—Tulsidas C. Patel
(74) *Attorney, Agent, or Firm*—Armstrong, Kratz, Quintos, Hanson & Brooks, LLP

(57) ABSTRACT

A piercing terminal having high reliability for crimping is provided, by which the terminal can be securely pierced through a flat circuit body even if the circuit body has a thick conductor. The terminal includes: a conductive basal plate; and a plurality of claw pieces arising from both sides in the width direction of the basal plate, wherein a protrusion height of each claw piece is different. Each of the pair of claw pieces may have the same protrusion height and a protrusion height of each pair is different from that of the other pair. A notch is formed between the claw pieces adjoining each other in the length direction of the basal plate. A plurality of the claw pieces are formed so that an imaginary line connecting the tops of the claw pieces gradually inclines as approaching an end in the length direction of the basal plate.

7 Claims, 8 Drawing Sheets

PIERCING TERMINAL AND MACHINE AND METHOD FOR CRIMPING PIERCING TERMINAL

BACKGROUND OF THE INVENTION

1. Field of the Invention

The present invention relates to a piercing terminal penetratingly connected to a flexible flat circuit body, in which the periphery of flat conductor portion is covered with a coating consisting of an insulator, such as a flexible print circuit (FPC) and flexible flat cable (FFC).

The present invention also relates to a machine and method for crimping a piercing terminal, by which the piercing terminal having a claw piece for piercing is crimp-connected to the flexible flat circuit body.

2. Description of the Related Art

An example of the art relating to such a piercing terminal and method for crimping a piercing terminal is described in Japanese Patent Publication No. S57-48833.

As shown in FIGS. 11 and 12, a piercing terminal 40 includes a crimp-connection part 43 having an approximately flat basal plate 41 and claw pieces 42 arising from both sides of the basal plate 41. Each claw piece 42 consists of a wide base 42*a* joining to the basal plate 41 and a narrow free end 42*b* continuing to the base 42*a*.

A flat circuit body 46 (see FIG. 12) being connected to the crimp-connection part 43 is a flexible circuit body, in which the periphery of a band-shaped conductor portion 47 is covered with a coating 48 consisting of an insulator, and is a thin circuit body called FPC or FFC.

The claw piece 42 adjoining each other in the length direction of the piercing terminal 40 is parted away from each other forming a tapered space therebetween. The base side of the claw piece 42 continues to the basal plate 41 and the joining portion of the claw pieces 42.

Since the claw piece 42 provided at both sides of the width direction of the basal plate 41 is alternately formed with each other, therefore at the opposite side of each claw piece 42 in the width direction, there is a tapered-shape space facing thereto. The claw piece 42 includes a round-shaped end 42*c* and a sharp side edge 42*d*.

At the center of the basal plate 41, there is provided a protrusively striped contact portion 44. In the direction crossing the contact portion 44 at right angles, there is formed a groove 45, which extends up to the inner surface of the claw piece 42.

As shown in FIG. 12, the claw piece 42 pierces through the conductor 47, thereby the piercing terminal 40 is fixed to the flat circuit body 46. The free end 42*b* of the claw piece 42 is caulked inwardly along a press surface 49*a* of a crimper 49 and stripes the coating 48 of the flat circuit body 46 away so as to come in contact with the conductor 47, thereby the electric conduction is attained.

However, the conventional piercing terminal described above has the following problems to be solved.

One problem is that since the piercing terminal 40 has a plurality of claw pieces 42, when the flat circuit body 46 becomes thick, the claw piece 42 might not be able to pierce through the flat circuit body 46. To the contrary, if the number of the claw pieces 42 is reduced, the connection between the piercing terminal 40 and the flat circuit body 46 might become insufficient, resulting in that the piercing terminal 40 might come off from the flat circuit body 46.

Another problem is that when the thickness of the conductor 47 becomes different, a plurality of the piercing terminals 40 having different size must be prepared. That is, when the piercing terminal 40 is crimped between an anvil (not shown in the figure) and crimper 49, the piercing terminal 40 forms a crimp height depending on the shape of the crimper 49. If the flat circuit body 46 or conductor 47 is thin, the end of the claw piece 42 does not reach the conductor 47, the connection between the piercing terminal 40 and the flat circuit body 46 might become insufficient. To the contrary, if the flat circuit body 46 or conductor 47 is thick, the protrusion length of the claw piece 42 becomes short, resulting in that the claw piece 42 might not be caulked in a curled shape.

In such a case described above, a piercing terminal having a suitable size must be selected and therefore, the number of parts increases causing the cost up and the parts control becomes complicated causing the deterioration in workability.

Another problem is that the contact area between the flat circuit body 46 and the claw piece 42, which depends on the caulked shape of the claw piece 42, is small. That is, since the radius of curvature of the caulked portion of the claw piece 42 is small, the contact area between the conductor 47 and the claw piece 42 is small, therefore a good electric conduction cannot be attained. That is, when the crimper 49 caulks the claw piece 42, if a fabrication error takes place, a good electric conduction might not be attained.

FIGS. 13A and 13B are cross sectional views before and after crimping, respectively, illustrating an example of a conventional method of crimping a piercing terminal.

A piercing terminal 240 and a flat circuit body 246 are sandwiched between a crimper 244, which is a die for pressing, and an anvil 245, which is a die as a pedestal, and caulked into each other so as to be crimped.

The anvil 245 is a pedestal, on which the piercing terminal 240 is placed, and there is formed a projection 245*a* having a trapezoid shape in its cross section on the center of the anvil 245. The projection 245*a* fits to the bottom of a protrusively striped contact portion 241*a* of the piercing terminal 240.

The crimper 244 is provided with a pair of curved portions 244*a*, each of which is parted away from the other by a protrusion 244*b* having a flat part. The protrusion 244*b* faces the projection 245*a* and is set to be movable relatively to the anvil 245.

However, the conventional method of crimping a piercing terminal described above has the following problems to be solved.

One problem is that the contact area between the flat circuit body 246 and the claw piece 242 of the piercing terminal 240, which depends on the caulked shape of the claw piece 242, is small. That is, the claw piece 242 is caulked inwardly along the curved portion 244*a* of the crimper 244 and since the radius of curvature of the bent portion of the claw piece 242 is small, if the thickness of the conductor 247 of the flat circuit body 246 becomes different, the contact area between the claw piece 242 and the conductor 247 becomes decreased or increased, therefore a good electric conduction might not be attained. Particularly, in case of an electric wire of an electric power system, since the electric wire supplies power from a battery to loads and a large current flows in the wire in comparison with a wire of a signal system, an electric resistance becomes large when the contact area is small, resulting in bad electric conduction.

In such a case, in order to adjust a crimp height of the piercing terminal 240, a distance between the crimper 244 and anvil 245 must be changed and otherwise the piercing terminal 240 having a different size must be prepared, resulting in that the parts control becomes complicated causing the deterioration in workability.

SUMMARY OF THE INVENTION

It is therefore an objective of the present invention to solve the above problems and to provide a piercing terminal having high reliability for crimping, by which the piercing terminal can be securely pierced through a flat circuit body even if the flat circuit body has a thick conductor and the piercing terminal has a plurality of claw pieces.

It is also an objective of the present invention to provide a highly reliable machine and method for crimping a piercing terminal, by which the piercing terminal can be securely crimp-connected to a flat circuit body having different thickness.

In order to attain the above objective, the present invention is to provide a piercing terminal to be connected to a flat circuit body comprising:

an electrically conductive basal plate; and a plurality of claw pieces arising from both sides in the width direction of the basal plate, wherein a protrusion height of each claw piece is different from that of the other claw piece.

With the construction described above, each claw piece pierces through the flat circuit body in sequence of their height and shearing force per claw piece becomes large even when there are a plurality of claw pieces, thereby the claw pieces securely pierce through the flat circuit body.

The present invention is to provide a piercing terminal to be connected to a flat circuit body comprising:

an electrically conductive basal plate; and a plurality of claw pieces arising from both sides in the width direction of the basal plate, wherein each of a pair of claw pieces has the same protrusion height and a protrusion height of each pair of claw pieces is different from that of the other pair of claw pieces.

With the construction described above, a pair of claw pieces simultaneously pierces through the flat circuit body, thereby the piercing can be carried out in a good balance.

Preferably, a notch is formed between the claw pieces adjoining each other in the length direction of the basal plate.

With the construction described above, the claw piece pierces through the flat circuit body up to the root thereof and the contact area between the claw piece and flat circuit body increases, thereby preventing defective joining from occurring.

Preferably, a plurality of the claw pieces are formed so that an imaginary line connecting the tops of the claw pieces gradually inclines as approaching an end in the length direction of the basal plate.

With the construction described above, each claw piece pierces through the flat circuit body in sequence of their height and since a crimper presses the end of the claw piece protruding from the flat circuit body, the claw piece is caulked in a curled-shape, thereby the flat circuit body is firmly held between the end of the claw piece and the basal plate of the piercing terminal.

The present invention is to provide a piercing terminal to be connected to a flat circuit body comprising:

an electrically conductive basal plate; and a plurality of pairs of claw pieces arising from both sides in the width direction of the basal plate, wherein a distance between a pair of claw pieces is different from that between the other pair of claw pieces.

With the construction described above, even if the flat circuit body has the conductor having a different width, at least one of the pairs of claw pieces electrically connects to the conductor, thereby preventing defective conduction from occurring. Further, there is no need to prepare a plurality of piercing terminals in response to the width of the conductor, thereby the number of the parts decreases and the cost can be reduced.

Preferably, each pair of claw pieces is arranged in a tapered shape in the length direction of the basal plate.

With the construction described above, the claw piece can securely and easily catches the flat circuit body and never comes off from the flat circuit body even when the flat circuit body is accidentally pulled in its length direction, thereby the holding power for holding the flat circuit body of the claw piece is improved.

Preferably, at least one pair of claw pieces is alternately formed.

With the construction described above, when the claw piece situated at both sides in the width direction of the flat circuit body is caulked in a curled-shape, the flat circuit body having the conductor of small width can be caulked without interference between the claw pieces at both sides. Therefore, even in a case of the flat circuit body having small width such as an electric wire of a signal system, a secure electric contact can be attained.

Preferably, a notch is formed between the claw pieces adjoining each other in the length direction of the basal plate.

With the construction described above, the claw piece pierces through the flat circuit body up to the root thereof and the contact area between the claw piece and flat circuit body increases, thereby preventing defective joining from occurring.

Preferably, a protrusion height of each pair of claw pieces is different from that of the other pair of claw pieces.

With the construction described above, each claw piece pierces through the flat circuit body in sequence of their height and shearing force per claw piece becomes large even when there are a plurality of claw pieces, thereby the claw pieces securely pierce through the flat circuit body.

The present invention is also to provide a machine for crimp-connecting a piercing terminal into a flat circuit body having a flat conductor, the piercing terminal including a plurality of claw pieces piercing through the flat circuit body, comprising:

a crimper for pressing; and an anvil as a pedestal facing the crimper, wherein the crimper is provided with a caulking portion facing the anvil, the caulking portion is provided with a pair of depressions each of which having a depressed curved surface and a protrusion having a protrusive curved surface situated between the pair of depressions, the boundary between the pair of depressions and the protrusion is linked with a smooth curved surface, and the caulking portion caulks the claw pieces of the piercing terminal.

With the construction described above, the claw piece of the piercing terminal protruding from the flat circuit body comes in surface contact with the flat circuit body along the conductor of the flat circuit body.

The present invention is also to provide a method of crimp-connecting a piercing terminal into a flat circuit body having a flat conductor, the piercing terminal including an electrically conductive basal plate and at least a pair of claw pieces arising from both sides of the basal plate, comprising the steps of:

sandwiching the flat circuit body and piercing terminal between a crimper for pressing and an anvil as a pedestal;

piercing the pair of claw pieces through the flat circuit body; and caulking the pair of claw pieces in a curled shape, wherein the pair of claw pieces protruding from the flat circuit body is inwardly curved imitating a depression of a caulking portion of the crimper and thereafter the pair of claw pieces is curved in the opposite direction of the inwardly curved direction imitating a protrusion of the caulking portion.

With the construction described above, the end of each claw piece is caulked along the conductor of the flat circuit body, and the approaching direction between the crimper and anvil becomes the same with the direction, in which the end of the claw piece presses the flat circuit body, thereby the piercing terminal firmly joins with the flat circuit body.

Preferably, when the pair of claw pieces is caulked with the crimper and anvil, a gap is formed between the flat circuit body and the protrusion of the crimper, thereby an end of the claw piece is advanced into the gap.

With the construction described above, the end of the claw piece is sandwiched and presses between the crimper and the flat circuit body, therefore the contact area between the claw piece and the flat circuit body increases, thereby preventing defective joining and defective conduction from occurring.

DESCRIPTION OF THE PREFERRED EMBODIMENTS

In the following, the preferred embodiments of the present invention will be explained with reference to the attached drawings.

Figure 1:
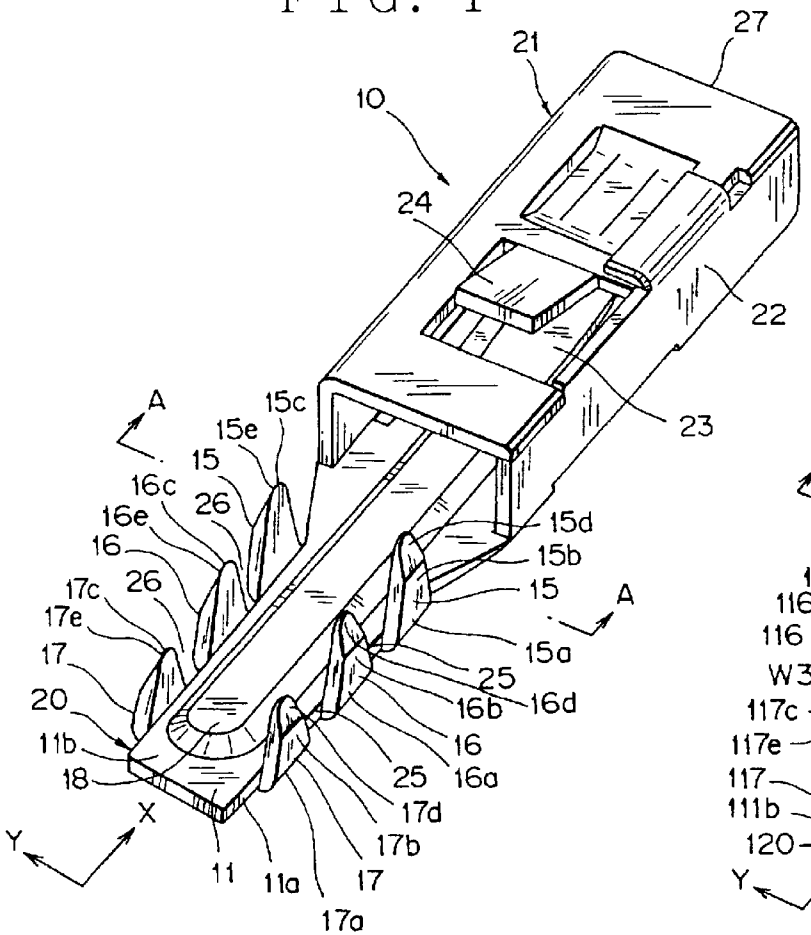
FIG. 1 is a perspective view illustrating a first preferred embodiment of a piercing terminal according to the present invention.
Figure 2:
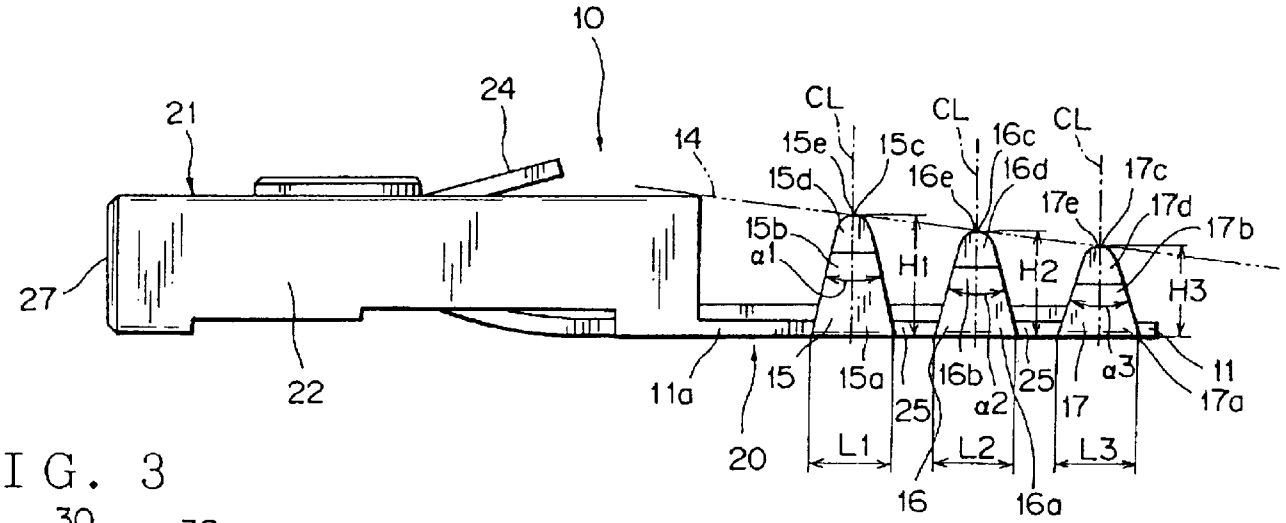
FIG. 2 is a side view illustrating the piercing terminal shown in FIG. 1.
Figure 3:
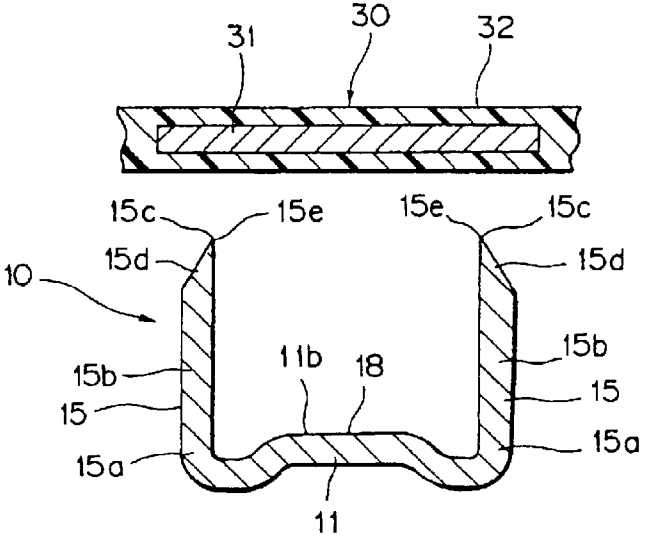
FIG. 3 is a cross sectional view illustrating the piercing terminal shown in FIG. 1 taken along A—A line.

FIGS. 1–3 illustrate a first preferred embodiment of a piercing terminal according to the present invention.

Figures 4, 11:
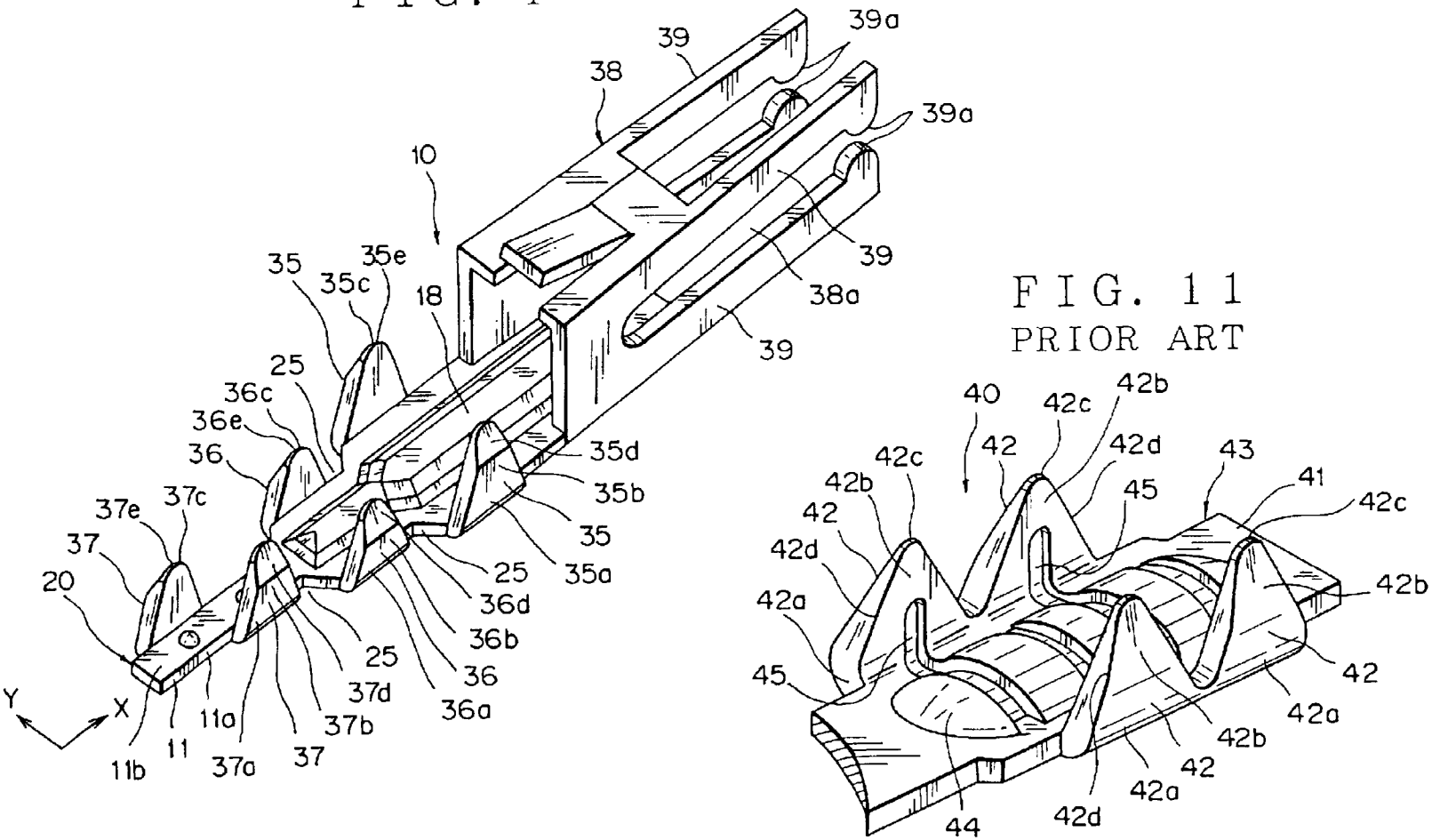
FIG. 11 PRIOR ART
FIG. 4 is a perspective view illustrating a second preferred embodiment of a piercing terminal according to the present invention.
FIG. 11 is a perspective view illustrating an example of a conventional piercing terminal.
Figures 5, 12:
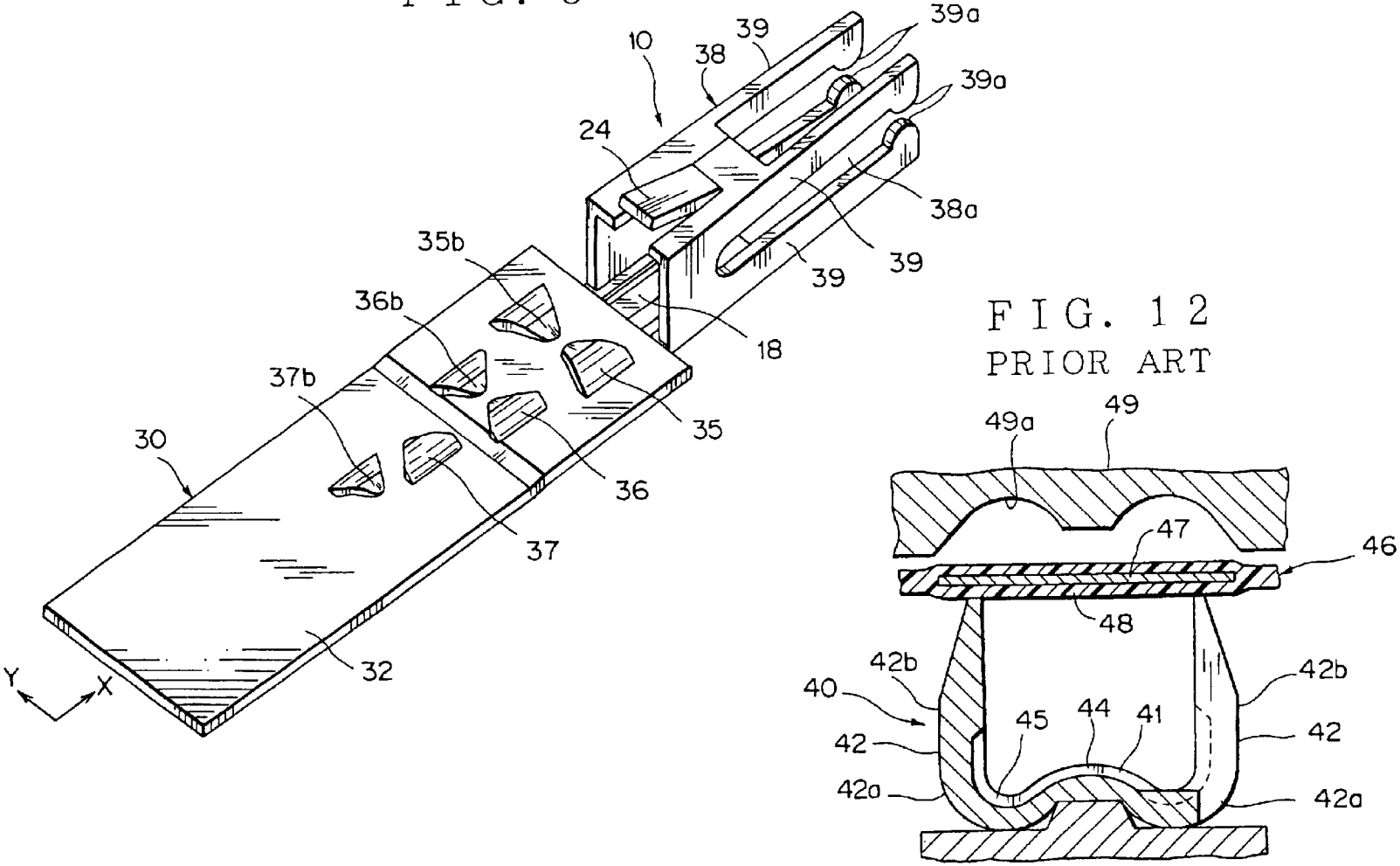
FIG. 12 PRIOR ART
FIG. 5 is a perspective view illustrating a state, in which a flat circuit body is crimp-connected to the piercing terminal shown in FIG. 4.
FIG. 12 is a cross sectional view illustrating the conventional piercing terminal shown in FIG. 11, a flat circuit body, and a crimper.

As shown in FIG. 1, a piercing terminal 10 is formed by die-punching and bending an electrically conductive plate, and has a wire-crimping part 20 at one side in the length direction X and a box-shaped electric contact part 21, which joins with a mating male terminal (not shown in the figure), at the opposite side. The electric contact part 21 is not limited to the present preferred embodiment and may be a tuning fork-shaped electric contact part 38 for a flat circuit body 30, which will be shown in a second preferred embodiment (FIGS. 4 and 5). Further, the electric contact part 21 may be one, in which a wire-crimping part 20 is formed at both sides in the length direction X (not shown in the figure). The piercing terminal according to the present invention can be applied to a joint terminal, in which a pair of piercing terminals are formed.

The piercing terminal 10, in which the electric contact part 21 or 38 is formed at one side, functions as a terminal that connects the flat circuit body 30 to electric parts. The piercing terminal 10, in which the wire-crimping part 20 is provided at both sides, functions as a terminal for relaying of the flat circuit body 30.

An electrically conductive plate 11 is bent, peripheral walls 22 thereof are formed, and a resilient contact piece 23 is formed inside, thereby the box-shaped electric contact part 21 is formed and can hold an electric contact part of a male terminal inserted from an opening 27 from the end thereof. On a top wall of the peripheral wall 22, there is formed a tongue-shaped locking piece 24 for preventing the piercing terminal 10, which is received in a connector housing (not shown in the figure), from coming off. The locking piece 24 is flexible and bends toward the inside of the electric contact part 21 when the piercing terminal 10 is inserted into the connector housing, and resiliently recovers its original shape after pushing the piercing terminal 10 up to a predetermined position, thereby the locking piece 24 is locked into an inner wall of the connector housing.

The front and back direction of the piercing terminal 10 is defined as follows. When the piercing terminal 10 is inserted into the connector housing, a side of the electric contact part 21 is defined as the front side while a side to be connected to the flat circuit body 30 is defined as the back side. Since the right and left sides of the piercing terminal 10 are equivalent, therefore they are not distinguished except in a case needed. As for the upper and lower directions, the upper direction is defined as a direction, in which the claw pieces 15, 16, 17 arise.

The wire-crimping part 20 is a part to which the end of the flat circuit body 30 (FIG. 3) such as a FFC is electrically connected and includes an electrically conductive basal plate 11 and claw pieces 15, 16, 17 arising from both sides in the width direction of the basal plate 11, wherein an upper side facing the basal plate 11 is formed open.

As shown in FIG. 3, the flat circuit body 30 is a flexible circuit body having a thin-plate shape or film shape and is used as a electric wire of an electric power system, which supplies the power from a battery or alternator to a load such as a motor, or as an electric wire of a signal system, which is connected to an electric part and carries out the transmitting and receiving of an electric signal. An electric wire of an electric power system is formed wider and thicker than that of a signal system. This is because a large current from a battery and the like flows into an electric wire of a power system and therefore, if the thickness of the wire is small, an insulator such as synthetic resin might melt. To the contrary, since no large current flows into a wire of a signal system, therefore the wire is formed thin.

The flat circuit body 30 includes a plurality of conductors 31 and a coating 32 which is an insulator. Each conductor 31 is covered with the coating 32 and insulated. The size of the conductor 31 is optional, that is, the conductor 31 is formed in a band shape with an optional specific width and thickness. Adjacent conductors 31 are arranged in parallel having a specific distance therebetween. As for the flat circuit body 30, the conductors 31 and the coating 32 are, integrally formed by insert molding.

As shown in FIG. 1, on an upper surface 11*b* of the basal plate 11, there is formed a protrusively striped contact portion 18 extending in the length direction X at the center in the width direction between a pair of claw pieces 15, 16, 17, thereby preventing defective crimping between the piercing terminal 10 and the flat circuit body 30 from occurring.

The protrusively striped contact portion 18 is formed by press working. In the present preferred embodiment, the contact portion 18 is integrally formed with the basal plate 11, instead it may be formed independently from the basal plate 11, otherwise the contact portion 18 may be formed by partially cutting out from the basal plate 11 so as to have flexibility.

If the contact portion 18 is made flexible, there is an advantage that the size control of the crimp height is not necessary. That is, even if the claw pieces 15, 16, 17 are not precisely formed, no defective crimping between the piercing terminal 10 and the flat circuit body 30 takes place and there is almost no damage for the conductor 31 of the flat circuit body 30.

Each of a pair of facing claw pieces 15, 16, 17 perpendicularly arising from both sides of the basal plate 11 has a sawtoothed shape and has a basal end 15*a*, 16*a*, 17*a*, and free end 15*b*, 16*b*, 17*b*.

The claw pieces 15, 16, 17 adjoining in the length direction X are arranged in parallel putting a notch 25 therebetween. Each basal end 15*a*, 16*a*, 17*a* is joined with a side surface 11*a* of the basal plate 11. Therefore, a space 26 is formed between the adjacent claw pieces, thereby the flat circuit body 30 can be pierced through up to the root of the claw piece so as to prevent defective crimping from occurring.

Each free end of the claw piece 15*b*, 16*b*, 17*b* corresponds to an upper half of the claw piece 15, 16, 17, and is a crimping piece for caulking and fixing the flat circuit body 30. Each free end of the claw piece 15*b*, 16*b*, 17*b* is caulked in a curled-shape by being pressed with a crimper (not shown in the figure).

Three pairs of claw pieces are formed along the length direction of the basal plate 11 in the present preferred embodiment. However, the number of claw pieces is optional, that is, the number of pairs may be two or more than three. Each of a pair of claw pieces 15, 16, 17 is formed facing each other in the width direction as shown in FIG. 1.

When each claw piece 15, 16, 17 is made facing the other claw piece in a pair, a balance upon piercing is improved, a positional accuracy for piercing is improved, and the piercing terminal 10 can be made shortened, that is, miniaturized. On the other hand, when each claw piece 37 is made alternately (FIGS. 4 and 5), the claw piece 37 does not interfere with each other even if the width of the conductor 31 of the flat circuit body 30 is small, thereby an electric connection can be securely attained.

The stress state of each claw piece 15, 16, 17 upon piercing is similar to that of a pillar which receives an axial compression load, which depends on the material of the flat circuit body 30, the thickness of the conductor 31, the number of claw pieces 15, 16, 17 simultaneously coming in contact with the flat circuit body 30, and the shape of the claw piece 15, 16, 17. In the following, the shape of the claw piece 15, 16, 17 will be explained.

As shown in FIG. 2, the claw pieces 15, 16, 17 are formed approximately perpendicularly arising from the basal plate 11 axial-symmetrically relatively to a central axis CL in order that each claw piece 15, 16, 17 is prevented from toppling down and being deformed upon piercing. That is, if each claw piece 15, 16, 17 is inclined relatively to the basal plate 11 or situated non-symmetrical relatively to the central axis CL, the bending force besides the compression force works so as to deform the claw piece 15, 16, 17.

Further, each free end 15*b*, 16*b*, 17*b* of the claw piece 15, 16, 17 is provided with a tapered portion 15*d*, 16*d*, 17*d*, which becomes thinner as approaching the end thereof, and a cutting blade 15*e*, 16*e* and 17*e*, by which the claw piece 15, 16, 17 can easily and smoothly pierces through the flat circuit body 30.

Since the size of the piercing terminal 10 is optional, various sizes of the claw piece 15, 16, 17 such as the protruding height (barrel height) H1, H2 and H3, the width of the claw piece L1, L2, L3, the thickness thereof, and the vertical angle are optional. The width and thickness of the claw piece determines the mechanical strength of the claw piece and is determined taking the cross sectional second moment and a ratio of the height of the claw piece to the minimum cross sectional second radius into consideration. The vertical angle is set 20°–60° taking the sharpness upon piercing into consideration.

The protruding height H1, H2 and H3 of the claw piece 15, 16, 17 is different per each pair of claw pieces 15, 16, 17. When the claw pieces 15, 16, 17 are alternately made, each protruding height H1, H2 and H3 is set different per corresponding claw piece 15, 16, 17.

Thereby, the number of claw pieces 15, 16, 17, which simultaneously comes in contact with the flat circuit body 30, is decreased and the shear force per each claw piece 15, 16, 17 becomes large, thereby the claw piece can securely pierce through the flat circuit body 30. In the present preferred embodiment, the height of three pairs of claw pieces 15, 16, 17 is set to be H1, H2, H3 in height sequence and a plurality of the claw pieces 15, 16, 17 are formed so that an imaginary line 14 connecting the tops 15*c*, 16*c*, 17*c* of the claw pieces gradually inclines descendingly as approaching the end in the length direction of the basal plate 11. The inclining direction of the imaginary line 14 depends on a reason of design and therefore, the imaginary line 14 may gradually inclines ascendingly as approaching the end in the length direction of the basal plate 11. Instead, a pair situated middle of the three pairs may be set protruding, without setting the three pairs, an imaginary line connecting the tops of the claw pieces of which is set inclined, as described above.

Each claw piece 15, 16, 17 pierces through the flat circuit body 30 in height sequence. Since only a single pair of claw pieces 15, 16, 17 simultaneously comes in contact with the flat circuit body 30, therefore the shear force per contact area becomes large, thereby the sharpness is improved.

The piercing terminal 10 is caulked by a crimper (not shown in the figure) and inserted into a terminal-receiving chamber of a connector housing forming a male connector, and can be electrically connected to a male terminal of a female connector (not shown in the figure).

FIG. 4 is a perspective view illustrating a second preferred embodiment of a piercing terminal according to the present invention. FIG. 5 is a perspective view illustrating a state, in which the piercing terminal shown in FIG. 4 is crimp-connected to a flat circuit body.

As shown in FIGS. 4 and 5, the piercing terminal 10 of the second preferred embodiment is similar to that of the first preferred embodiment in points that a wire-crimping part 20 is formed at one end while an electric contact part 38 is formed at the other end and that the wire-crimping part 20 includes an electrically conductive basal plate 11 and a plurality of claw pieces 35, 36, 37 arising from both sides of the basal plate 11.

On the other hand, the piercing terminal 10 of the second preferred embodiment is different from that of the first preferred embodiment in points that one pair of claw pieces 37 of the wire-crimping part 20 is alternately formed in the length direction X and that the flat circuit body 30 is connected to the electric contact part 38.

Since one pair of claw pieces 37 at the end side of the piercing terminal 10 is alternately formed, therefore the distance between the two claw pieces in the width direction can be set small and the crimping can be securely carried out even if the flat circuit body 30 has the conductor 31 having small width. Further, the possible interference between the ends of the claw pieces 37, which are caulked in a curled shape, can be prevented from occurring, thereby defective crimping and deformation of the end of the claw piece 37 can be prevented from occurring.

The electric contact part 38 is formed on a side wall, which is formed by bending the electrically conductive basal plate 11 into a box-shape. The side wall at both sides is provided with tuning fork-shaped contact parts 39, which is formed as a pair up and down in a beam shape. A receiving space 38*a* for receiving the flat circuit body 30 is formed between the pair of beam-shaped contact parts 39. The receiving space 38*a* extends up to the vicinity of the rear end of the side wall. At the end of each beam-shaped contact parts 39, there is formed a claw 39*a*, which holds the conductor 31 of the flat circuit body 30.

Figure 6:
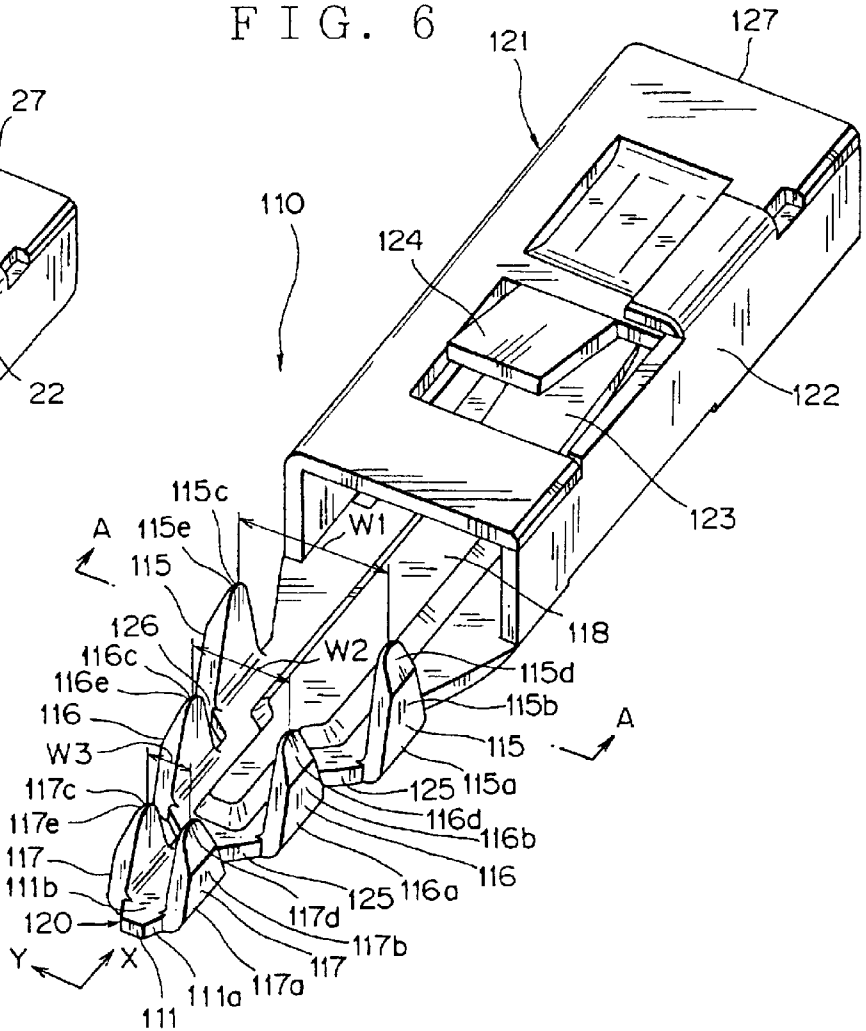
FIG. 6 is a perspective view illustrating a third preferred embodiment of a piercing terminal according to the present invention.

FIG. 6 is a perspective view illustrating a third preferred embodiment of a piercing terminal according to the present invention.

Each distance W1, W2 and W3 between a pair of facing claw pieces 115, 116 and 117 is different per pair and gradually becomes smaller as approaching the end side of the basal plate 111. This setting described above depends on a reason of design and therefore, if the mechanical strength of the piercing terminal 110 can be maintained, the distance may gradually becomes larger as approaching the end side of the basal plate 111 or may not change in a specific way. The point is that each distance W1, W2 and W3 between a pair of facing claw pieces 115, 116, 117 is different per pair.

With the construction described above, even if the flat circuit body has the conductor of a different width, at least one pair of claw pieces among a plurality of the pairs can be electrically connected to the conductor, thereby preventing defective conduction from occurring. Further, there is no need to prepare a plurality of piercing terminals 110 in response to the width of the conductor, thereby the number of the parts decreases and the cost can be reduced. The piercing terminal 110 according to the present invention can be applied to a flat circuit body having small width such as an electric wire of a signal system besides an electric wire of a power system.

Figure 7:
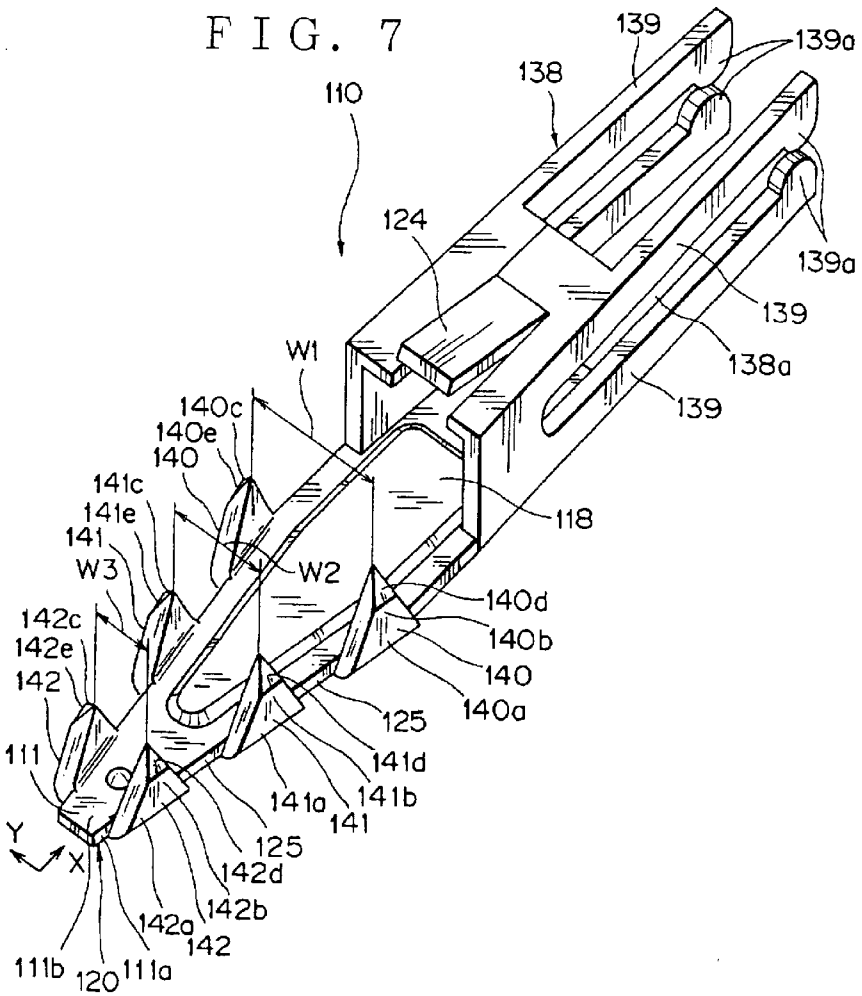
FIG. 7 is a perspective view illustrating a fourth preferred embodiment of a piercing terminal according to the present invention.

FIG. 7 is a perspective view illustrating a fourth preferred embodiment of a piercing terminal according to the present invention.

A piercing terminal 110 shown in FIG. 7 is different from the second and third preferred embodiments of the piercing terminal in a point that an electrically conductive basal plate 111 is formed in a tapered shape as approaching the end thereof and each claw piece 140, 141, 142 is formed in a tapered shape. On the other hand, the piercing terminal 110 shown in FIG. 7 is similar to the second and third preferred embodiments of the piercing terminal in a point that a protrusion height of each claw piece 140, 141, 142 is different from that of the other claw piece. The piercing terminal 110 shown in FIG. 7 is similar to the second preferred embodiment of the piercing terminal in a point that an electric contact part 138 is formed at the rear end side of the basal plate 111.

In this preferred embodiment, in every pair of claw piece 140, 141, 142, each claw piece faces the other claw piece. Instead, only one pair of claw pieces 142 at the end side may be alternately formed similarly to the second preferred embodiment, otherwise three pairs of claw pieces may be alternately formed. Further, only each claw piece 140, 141, 142 may be formed in a tapered shape and the basal plate 111 may not be formed in a tapered shape as approaching the end thereof.

With the construction described above, the claw pieces 140, 141, 142 can securely and easily catches the flat circuit body and never comes off from the flat circuit body even when the flat circuit body is accidentally pulled in its length direction, thereby the holding power for holding the flat circuit body of the claw piece is improved.

Figure 8:
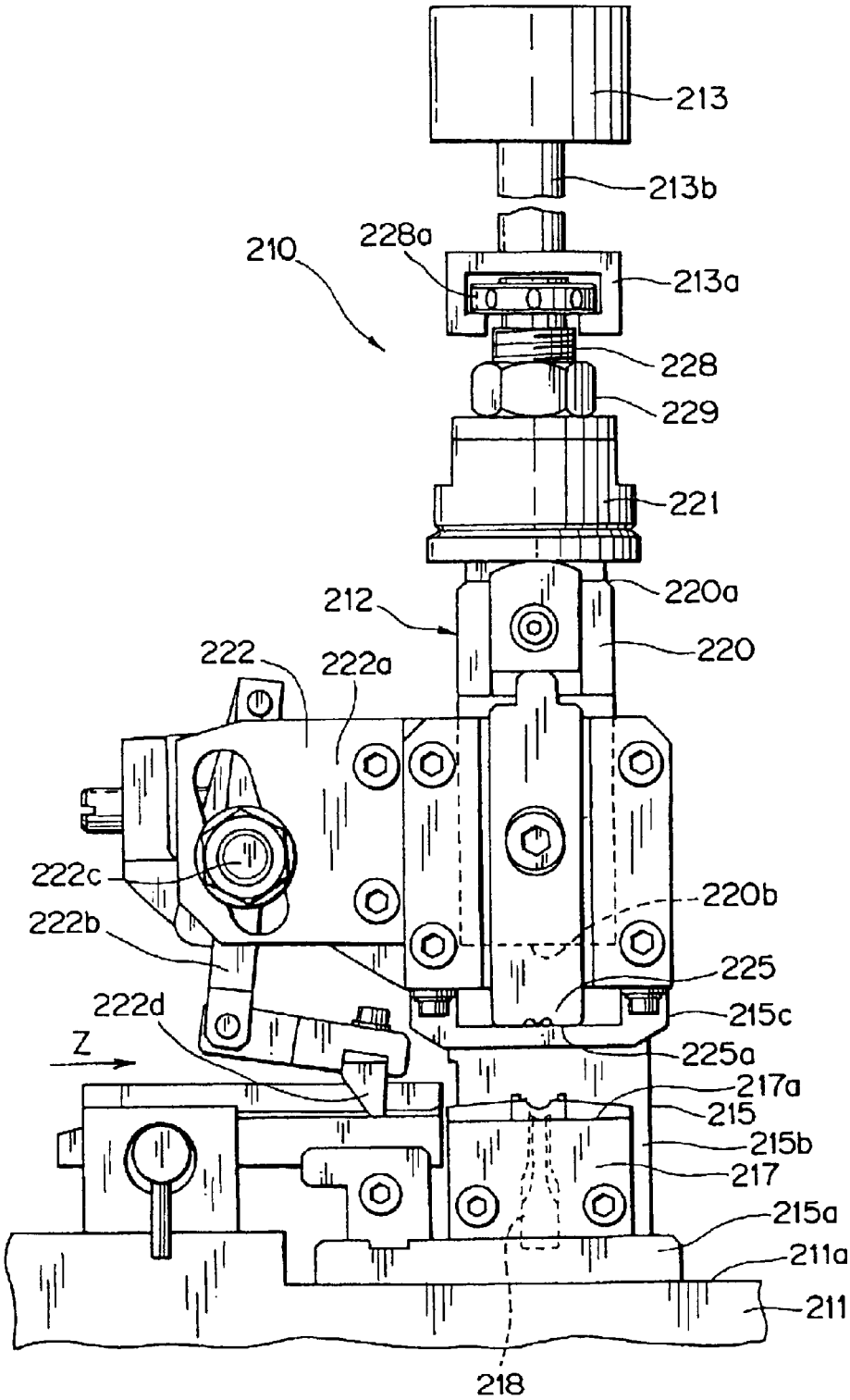
FIG. 8 is a front view illustrating a preferred embodiment of a machine for crimping a piercing terminal according to the present invention.

FIG. 8 is a front view illustrating a preferred embodiment of a machine for crimping a piercing terminal according to the present invention.

A machine for crimping a piercing terminal (hereinafter, crimping machine) 210 includes a base 211, a crimping applicator 212 for crimp-connecting a piercing terminal 231 to a flat circuit body 246, and a drive source 213.

The crimping applicator 212 includes a crimper 225 and anvil 218, wherein claw pieces 234, 235, 236 of a piercing terminal 231 are pierced through a conductor 247 of a flat circuit body (electric wire) 230 by a hoisting action of the crimper 225, thereby the crimping between the piercing terminal 231 and the flat circuit body 230 is attained. A rotational motion of a servomotor (not shown) is converted to a linear motion by a piston-crank mechanism (not shown) and a ram 220 holding a crimper 225 is dropped and raised, thereby the hoisting action of the crimper 225 is attained. A control section for controlling the hoisting action of the ram 220 controls the acceleration/deceleration of the ram 220, crimping and standby. In the following, the whole construction of the crimping machine 210 including the crimping applicator 212 will be explained.

The base 211 includes a flat portion 211*a*, which is flat along the horizontal direction. The crimping applicator 212 is placed on the base 211 and fixed there.

The drive source 213 includes a servomotor (not shown), drive shaft 213*b* transmitting the drive force, and a hook 213*a* which is caught to a disc 228*a* of a shank 228

(explained later on). The rotational motion of the servomotor is converted to a linear motion by a piston-crank mechanism, thereby the hoisting action of the ram 220 is attained Instead of the servomotor, a hydraulic cylinder having a piston rod connected to the shank 228 with a direct-drive mode may be employed as the drive source 213.

The crimping applicator 212 includes a frame 215, holder 217 having an anvil 218, ram 220 continuing to the frame 215, ram bolt 221 which is raised and dropped engaging with the ram 220, shank 228 with which the ram bolt 221 engages, and unit 222 for transferring a piercing terminal.

The frame 215 includes a mount 215*a* for mounting the holder 217 thereon, pillar 215*b* extending upward, and ram-holder 215*c*. The frame 215 is placed on the flat portion 211*a* of the base 211 and fixed with a bolt (not shown) and nut (not shown) or the like. The frame 215 may be fixed integrally with the base 211.

The ram-holder 215*c* is connected to the upper end of the pillar 215*b* which extends upward from the mount 215*a*. The ram-holder 215*c* is provided with a space for guiding the ram 220 so that the ram 220 can be slidably inserted thereinto.

An anvil 218 on which a piercing terminal 231 is placed is embedded in the holder 217. The holder 217 includes a flat surface 217*a* facing the crimper 225 and a lower end surface 220*b* of the ram 220. The flat surface 217*a* is formed flat along the direction crossing a direction, in which the ram 220 rises and falls, and the anvil 218 approaches or is parted from the crimper 225.

The anvil 218 is received and held in the holder 217, and is mounted on the mount 215*a* of the frame 215. The anvil 218 is held with its bottom wall being adhered on the bottom wall of the holder 217, thereby a piercing terminal 231 is placed thereon relatively firmly.

The piercing terminal 231 abuts against the anvil 218 at the lower end of the wire-crimping part 232 thereof, and when being applied the pressure of the crimper 225, the piercing terminal 231 is held by the anvil 218 so as to be caulked in a predetermined shape.

The ram 220 is formed rectangular. The ram 220 is held by the ram-holder 215*c* movable up and down in a perpendicular direction. The length direction of the ram 220 extends along the perpendicular direction. A lower end surface 220*b* of the ram 220 is formed flat along the direction crossing the direction of hoisting.

The crimper 225 is mounted on the lower half of the ram 220 so as to face the anvil 218. The ram 220 is held movable up and down by the ram-holder 215*c*, thereby the crimper 225 approaches and is parted from the anvil 218. That is, in cooperation with the crimper 225 approaching and being parted away from the anvil 218, the ram 220 is raised and dropped.

The crimper 225 is formed in a shape corresponding to three pairs of claw pieces 35, 36, 37 of the piercing terminal 10 shown in FIG. 4. That is, it is formed in a shape corresponding to the protruding height of each pair of claw pieces 35, 36, 37. The crimper may be integrally formed as shown in the present preferred embodiment or instead, may be dividedly formed into three pieces so as to correspond to three pairs of claw pieces 35, 36, 37. Similarly, the anvil 218 facing the crimper 225 may be dividedly formed into three pieces.

Figure 9:
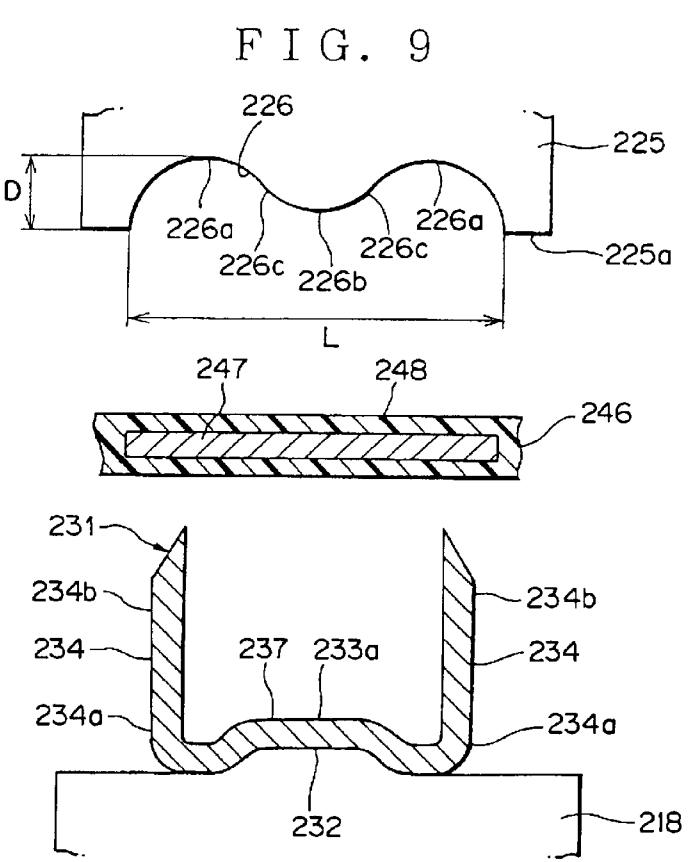
FIG. 9 is a side view illustrating positional relation among a crimper and anvil of the machine shown in FIG. 8, a flat circuit body, and a piercing terminal.

FIG. 9 is a side view illustrating positional relation among the crimper and anvil of the machine shown in FIG. 8, a flat circuit body, and a piercing terminal.

As shown in FIG. 9, the crimper 225 is a die for pressing. An M-shaped caulking part 226 is formed on a lower end surface 225*a* facing the anvil 218. The caulking part 226 includes a pair of depressions 226*a* each of which having a depressed curved surface and a protrusion 226*b* having a protrusive curved surface situated between the pair of depressions 226*a*. The boundary 226*c* between the pair of depressions 226*a* and the protrusion 226*b* is formed with a smooth and continuous curved surface.

With the construction of the caulking part 226 described above, when the piercing terminal 231 is sandwiched between the crimper 225 and anvil 218, the ends 234*b*, 235*b*, 236*b* of the claw pieces 234, 235, 236 of the piercing terminal 231 are inwardly curved imitating the depression 226*a* of the caulking portion 226 of the crimper 225 and thereafter the pair of claw pieces 234, 235, 236 are curved in the opposite direction of the inwardly curved direction imitating the protrusion 226*b* of the caulking portion 226. Then, the ends 234*b*, 235*b*, 236*b* of the claw pieces 234, 235, 236 of the piercing terminal 231 are advanced into a gap 227 (FIG. 10) between the flat circuit body 246 and the crimper 225, thereby the piercing terminal 231 and the flat circuit body 246 approach to each other and are caulked. Therefore, the ends 234*b*, 235*b*, 236*b* of the claw pieces 234, 235, 236 of the piercing terminal 231 can be prevented from breaking through and damaging the conductor 247 of the flat circuit body 246.

In a conventional example mentioned in the Related Art, there is formed an edge line at the boundary between the curved portions 244*a* and the protrusion 244*b*, and the end 242*b* of the claw piece 242 is only bent in the same direction in an eddy shape, therefore the claw piece never enters into the lower side of the protrusion 244*b* and the claw piece might be stuck into the conductor 247 of the flat circuit body 246, thereby causing a problem.

However, in the present invention, since the claw pieces 234, 235, 236 can enter into the lower side of the protrusion 226*b*, such a problem described above never takes place. Further, the claw pieces 234, 235, 236 is never bent with a small radius of curvature, thereby never causing a crinkle-shaped crack. Furthermore, since the contact area relative to the flat circuit body 246 is increased, therefore the reliability of contact and crimping can be improved.

The width L of the caulking portion 226 and the depth D of caulking are determined according to the crimp width W (crimp width of the claw piece) and the crimp height H (crimp height of the claw piece), and are optional. The width L is set larger than the crimp width W so that the claw pieces 234, 235, 236 can advance and be guided into the depression 226*a* even if the claw pieces 234, 235, 236 are not situated perpendicular relatively to the basal plate 237 but in an opened state relatively to the basal plate 237. The depth D of caulking determines the crimp height H of the claw pieces 234, 235, 236 and is set to be a predetermined value taking the allowable thickness of the flat circuit body 246 and the protruding height of the claw pieces 234, 235, 236 into consideration.

The contact state between the claw pieces 234, 235, 236 and the flat circuit body 246 depends on the depth D of caulking and so on. When the ends 234*b*, 235*b*, 236*b* of the claw pieces 234, 235, 236 of the piercing terminal 231 do not reach the conductor 247 of the flat circuit body 246, it might cause defective conduction. However, in the present invention, since the boundary 226*c* between the pair of depressions 226*a* and the protrusion 226*b* is formed with a smooth and continuous curved surface, therefore the claw pieces 234, 235, 236 can slide smoothly, thereby preventing defective conduction from occurring.

The distance between the crimper 225 and anvil 218 is set to be a predetermined value not depending on the thickness of the conductor 247 of the flat circuit body 246. That is, the crimp height H of the wire-crimping part 232 is always set to be a constant value not depending on the thickness of the conductor 247 of the flat circuit body 246. The material for the crimper 225 and anvil 218 is preferably tool alloy steel for cold mold and is precisely finished by electric discharge machining.

Conventionally, the distance between the crimper 244 and anvil 245 has been adjusted according to the thickness of the conductor of the flat circuit body 246 and the different crimp height has been set per the flat circuit body 246, thereby the number of control items increases and the workability deteriorates. With the present invention, such problems can be prevented from occurring.

With the construction described above, the anvil 218 and crimper 225 approach to each other and sandwich the piercing terminal 231 and the end of the flat circuit body 246 therebetween, thereby caulking and crimping the claw pieces 234, 235, 236 of the piercing terminal 231. Consequently, the shape of caulking is a shape, in which the shape of the crimper 225 is transcribed.

Generally, even if the positioning accuracy of the crimper 225 and anvil 218 of the crimping applicator 212 lies within an allowable range, an error thereof never becomes zero. If the positioning accuracy is not good, defective conduction might take place. However, in the present invention, it is possible to respond to the thickness of the conductor of the flat circuit body 246 without changing the crimp height H, thereby an adjusting work for positioning is unnecessary and the efficiency of the crimping work can be improved.

The ram bolt 221 is screwed into a tapped hole of the upper end surface 220*a* of the ram 220. When the ram bolt 221 is screwed on the ram 220, the ram 220 can move up and down.

The shank 228 is formed in a hollow cylindrical shape. The shank 228 is connected to the hook 213*a* of the drive source 213 at the disc 228*a* of one side thereof while screwed into a tapped hole of the ram bolt 221 at a screw of the opposite side thereof. That is, the shank 228 transmits the drive force from the drive source 213 to the ram 220 through the ram bolt 221 so as to move the crimper 225 up and down.

The shank 228 is connected to the ram bolt 221 in such a manner that the penetration depth of the shank 228 in the tapped hole of the ram bolt 221 is adjusted so as to change the relative position of the shank 228 to the ram bolt 221. When the relative position of the shank 228 to the ram bolt 221 is changed, the distance between the anvil 218 and crimper 225 is changed accordingly.

The shank 228 is provided with a nut 229 screwing into a thread groove. When the shank 228 is screwed into the tapped hole of the ram bolt 221, the shank 228 is fixed to the ram bolt 221 by fastening the nut 229.

The unit 222 for transferring a piercing terminal includes a cam (not shown) provided at the side of the ram 220, a connecting rod (not shown) moving horizontally abutting against the cam, a lever holder 222*a* receiving the connecting rod therein, a crank-shaped lever 222*b* being fit into the lever holder 222*a*, a pivot 222*c* for rotatably holding the lever 222*b*, and a claw 222*d* for feeding a piercing terminal, which is provided at an end of the lever 222*b*.

When the cam is dropped by the drive force of the drive source 213, an end at one side of the connecting rod abuts against the cam and is pushed in the horizontal direction, an end at the opposite side of the connecting rod abuts against the lever 222*b*, the lever 222*b* rotates around the pivot 222*c*, and the claw 222*d* caught by a hole of a chain belt (not shown) forwards the chain belt in the terminal-forwarding direction Z (FIG. 8) per one piercing terminal.

The flat circuit body 246 is placed on the piercing terminal 231 transferred to a working position of the anvil 218. When the ram 220 is dropped, the flat circuit body 246 is sandwiched between the anvil 218 and the crimper 225 and then, the claw pieces 234 of the piercing terminal 231 pierce through the flat circuit body 246, thereby the claw pieces 234 are caulked and crimped.

The chain belt in which a plurality of piercing terminals are chained is linked in a line by a carrier and forwarded per one piercing terminal, crimped, and cut per one piercing terminal. After being crimped, the lever 222*b* recovers its original position by a resilient force of a spring and the like.

As described above, the unit 222 has an advantage of automation of a series of crimping work. Instead, the crimping work can be carried out by hand with feeding every piercing terminal 231 onto the anvil 218.

Figure 10A:
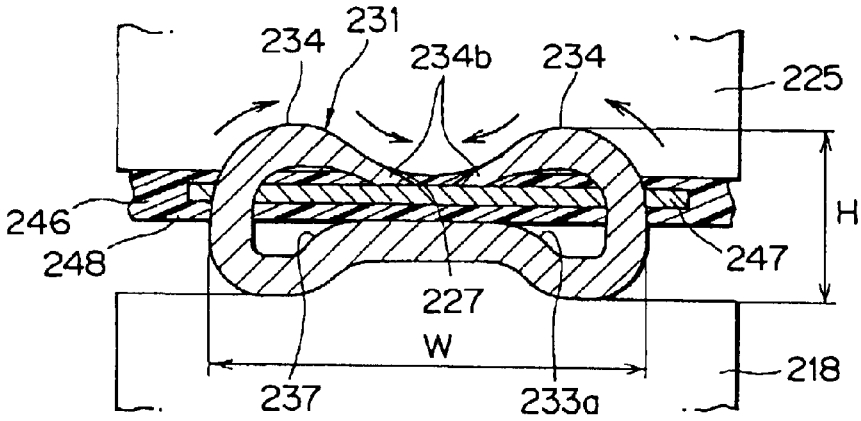
FIGS. 10A, 10B and 10C are cross sectional views illustrating caulked shape of a piercing terminal caulked by the machine shown in FIG. 8, in which a flat circuit body has a conductor of different thickness from each other.
Figure 10B:
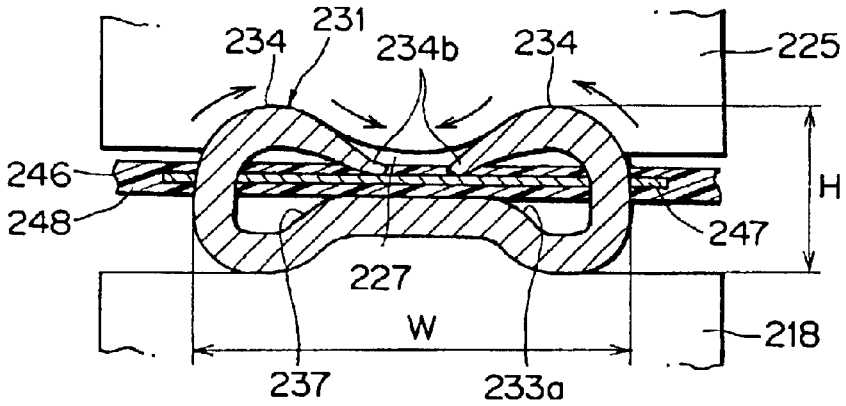
Figure 10C:
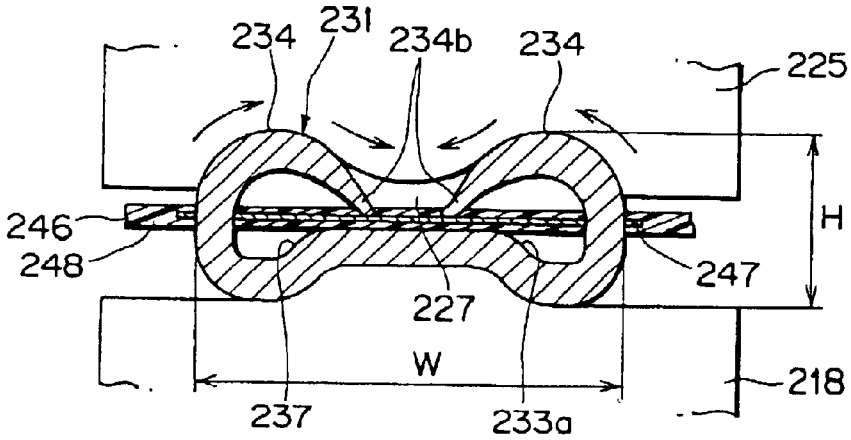
Figure 13A:
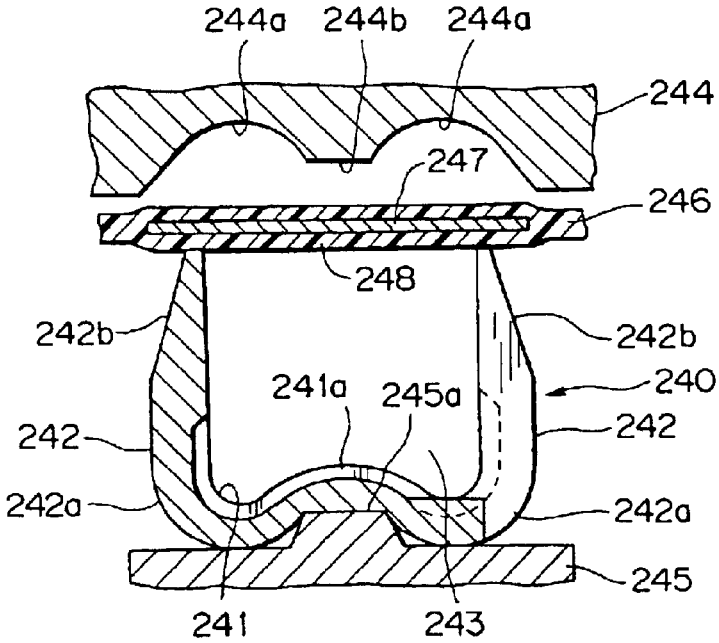
FIG. 13A PRIOR ART
FIGS. 13A and 13B are cross sectional views before and after crimping, respectively, illustrating an example of a conventional method of crimping a piercing terminal.
Figure 13B:
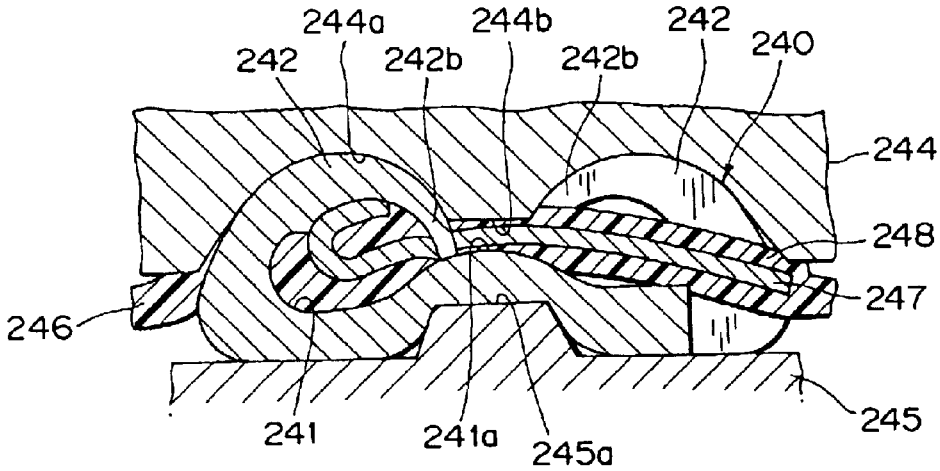
FIG. 13B PRIOR ART

FIGS. 10A, 10B and 10C are cross sectional views illustrating caulked shape of a piercing terminal 231 caulked by the machine 210 shown in FIG. 8, in which a flat circuit body 246 has a conductor 247 of different thickness from each other. The basal plate 237 of the piercing terminal 231 is provided with a protrusively striped contact portion 233*a*. The flat circuit body 246 is sandwiched between the contact portion 233*a* and the end 234*b* of the claw piece 234, thereby they are electrically connected to each other.

The caulked shape of the claw piece 234 looks like a pair of glasses, in which a pair of the claw pieces 234 is inwardly bent. Each end 234*b* of the claw piece 234 faces the other end 234*b* having a specific distance therebetween.

FIGS. 10A, 10B and 10C are cross sectional views illustrating caulked shape of the piercing terminal 231, in which the flat circuit body 246 has the conductor 247 of different thickness from each other. Even when the thickness of the conductor 247 changes, the crimp height H and crimpe width W are common in these three cases of FIGS. 10A, 10B and 10C.

When comparing the caulked shape in these figures, in FIGS. 10A and 10B, each end 234*b* of the claw piece 234 extends along the conductor 247 and is situated closely to the other end 234*b*. Accordingly, the contact area of the claw piece 234 relative to the flat circuit body 246 is large. Further, the flat circuit body 246 comes in close contact with the end 234*b* of the claw piece 234.

In general, the flat circuit body 246 having a thick conductor 247 is an electric wire of a power system, which is connected to a motor and the like, and a large current flows in the flat circuit body 246 and therefore, if the contact area described above is small, the electric resistance becomes large, possibly causing defective electric conduction. However, in the present invention, since the claw piece 234 lies down along the conductor 247, the contact area becomes large, preventing the defective conduction from occurring.

On the other hand, in FIG. 10C, each end 234*b* of the claw piece 234 comes in contact with the conductor 247 abutting against the conductor 247. Although the end 234*b* comes in contact therewith and accordingly the contact area is small, the electric connection is indeed attained. Since each end 234*b* of the claw piece 234 is bent imitating a curved surface of the crimper 225, the end 234*b* never damages the conductor 247.

Since the flat circuit body 246 having a thin conductor 247 is an electric wire of a signal system, a large current never flows in the flat circuit body 246. In this case, since a need is only the transmission and receiving of a signal, the small contact area between the flat circuit body 246 and the claw piece 234 does not matter.

FIG. 5 is a perspective view illustrating a state, in which a flat circuit body 30 is crimp-connected to a piercing terminal 10. Three pairs of claw pieces 35, 36, 37 protruding from the flat circuit body 30 are inwardly caulked and crimp the flat circuit body 30 without interfering with each other at the end 35*b*, 36*b*, 37*b* thereof.

Each pair of claw pieces 35, 36, 37 has a different protrusion height per a pair of claw pieces and accordingly the depth D (FIG. 9) of caulking of caulking part 226 of the crimper 225 is different per a pair of claw pieces in order to respond to the flat circuit body 30 (FIG. 5) having a conductor of different thickness. The method of crimp-connecting a piercing terminal into a flat circuit body having a flat conductor according to the present invention is effective for such a piercing terminal 10, that is, the secure electric contact can be attained without suffering defective conduction caused by the damage of a flat circuit body and the reliability of crimping can be improved.

The aforementioned preferred embodiments are described to aid in understanding the present invention and variations may be made by one skilled in the art without departing from the spirit and scope of the present invention.

What is claimed is:

1. A piercing terminal to be connected to a flat circuit body comprising:

an electrically conductive basal plate; and a plurality of claw pieces arising from both sides in the width direction of the basal plate, wherein each of a pair of claw pieces has the same protrusion height and a protrusion height of each pair of claw pieces is different from that of the other pair of claw pieces, and wherein a plurality of the claw pieces are formed so that an imaginary line connecting the tops of the claw pieces gradually inclines as approaching an end in the length direction of the basal plate.

2. The piercing terminal according to claim 1, wherein a notch is formed between the claw pieces adjoining each other in the length direction of the basal plate.

3. A piercing terminal to be connected to a flat circuit body comprising:

an electrically conductive basal plate; and a plurality of pairs of claw pieces arising from both sides in the width direction of the basal plate, wherein a distance between any one pair of claw pieces is different from that between all of the other pairs of claw pieces.

4. The piercing terminal according to claim 3, wherein each pair of claw pieces is arranged in a tapered shape in the length direction of the basal plate.

5. The piercing terminal according to claim 3 or 4, wherein at least one pair of claw pieces is alternately formed.

6. The piercing terminal according to claim 3 or 4, wherein a notch is formed between the claw pieces adjoining each other in the length direction of the basal plate.

7. The piercing terminal according to claim 3 or 4, wherein a protrusion height of each pair of claw pieces is different from that of the other pair of claw pieces.

* * * * *